US007591237B2

(12) United States Patent
Lou

(10) Patent No.: US 7,591,237 B2
(45) Date of Patent: Sep. 22, 2009

(54) ELECTROMECHANICAL VARIABLE VALVE ACTUATOR WITH A SPRING CONTROLLER

(75) Inventor: Zheng Lou, Plymouth, MI (US)

(73) Assignee: LGD Technology, LLC, Plymouth, MI (US)

( * ) Notice: Subject to any disclaimer, the term of this patent is extended or adjusted under 35 U.S.C. 154(b) by 322 days.

(21) Appl. No.: 11/701,268

(22) Filed: Feb. 1, 2007

(65) Prior Publication Data

US 2007/0181087 A1 Aug. 9, 2007

Related U.S. Application Data

(60) Provisional application No. 60/765,012, filed on Feb. 3, 2006.

(51) Int. Cl.
*F01L 9/04* (2006.01)

(52) U.S. Cl. ..... 123/90.11; 123/90.15; 123/90.12

(58) Field of Classification Search ..... 123/90.11, 123/90.12, 90.15; 251/129.01, 129.1, 129.16
See application file for complete search history.

(56) References Cited

U.S. PATENT DOCUMENTS 5,156,067 A * 10/1992 Umeyama ..... 464/68.3
5,996,539 A 12/1999 Göbel
2004/0060529 A1* 4/2004 Nan et al. ..... 123/90.12

* cited by examiner

*Primary Examiner*—Zelalem Eshete

(57) ABSTRACT

Actuators, and corresponding methods and systems for controlling such actuators, provide independent lift and timing control with minimum energy consumption. In an exemplary embodiment, an electromechanical actuator comprises a housing, first and second electromagnets rigidly disposed in the housing and separated from each other by an armature chamber, an armature disposed in the armature chamber and movable between the first and second electromagnets, an armature rod rigidly connected with the armature and operably connected with a load, at least one first actuation spring biasing the armature in a first direction, at least one second actuation spring biasing the armature in a second direction, and one fluid-operated spring controller capable of controlling the position of the first-direction end of the at least one second actuation spring. The spring controller allows the actuation springs at their least compressed state and the engine valve closed when engine power is off. The spring controller may also be adjusted, with a low or moderate control fluid pressure, to allow the engine valve to operate with a partial lift.

19 Claims, 7 Drawing Sheets

ELECTROMECHANICAL VARIABLE VALVE ACTUATOR WITH A SPRING CONTROLLER

REFERENCE TO RELATED APPLICATION

This application claims priority to Provisional U.S. Patent Application No. 60/765,012, file on Feb. 3, 2006, the entire content of which are incorporated herein by reference.

FIELD OF THE INVENTION

This invention relates generally to actuators and corresponding methods and systems for controlling such actuators, and in particular, to actuators providing independent lift and timing control with minimum energy consumption.

BACKGROUND OF THE INVENTION

Variable valve actuation (VVA) systems are used to actively control the timing and lift of engine valves to achieve improvements in engine performance, fuel economy, emissions, and other characteristics. Depending on the means of the control or the actuator, VVA systems are classified as mechanical, electrohydraulic, and electromechanical (sometimes called electromagnetic). Depending on the extent of the control, they are classified as variable valve-lift and timing, variable valve-timing, and variable valve-lift. They are also classified as cam-based or indirect acting and camless or direct acting. In the case of a cam-based system, the traditional engine cam system is kept and modified somewhat to indirectly adjust valve timing and/or lift. In a camless system, the traditional engine cam system is completely replaced with electrohydraulic or electromechanical actuators that directly drive individual engine valves. All current production automotive variable valve systems are cam-based, although camless systems will offer broader controllability, such as individual valve control and cylinder or valve deactivation, and thus better fuel economy.

The most prevailing design of an electromechanical VVA (or EMVVA) actuator includes an armature moving longitudinally between first and second electromagnets, a rod connected with the armature and an engine valve, and a pair of actuation springs attached to the rod and urging or centering the moving mass to a zero spring force or neutral position when the armature is not latched on either of the electromagnets. The engine valve is kept to closed and open positions when the armature is latched to the first and second electromagnets, respectively. For a simple, full-lift valve actuation, this spring-mass pendulum system is energy efficient, with the springs storing and releasing potential energy and the moving mass accumulating and releasing kinetic energy.

The prevailing EMVVA design does have several problems or potential problems. One of them is its power-off state. When engine power is off, the net spring force of the two actuation springs keeps the engine valve half open and the armature at the middle point between the two electromagnets. In certain vehicle regulations, it is required to keep engine valves closed at power-off. Also, to initialize an EMVVA actuator at the start of power-on, great effort and a large amount electrical current are spent to pull the armature from the middle point to either of the two electromagnets because of the nonlinear nature of the electromagnetic force. Therefore, it is desirable to keep the engine valve at the closed position and the armature near the first electromagnet.

With its fixed placement of the electromagnets and the actuation springs and nonlinear magnetic forces, prevailing EMVVA actuators also have trouble actuating an engine valve with a short stroke or lift, which is generally desirable and in some cases necessary for low load and idle engine operations. Some prevailing EMVVA actuators may perform short-lift actuation, but at great expense of electrical energy sustaining a large electromagnetic force through a substantial air gap to counter the spring centering force. This additional electrical energy further stretches the limit of a vehicle electrical system, especially during low load and idle operations when the vehicle alternator or electrical generator is the least efficient.

Disclosed in U.S. Pat. No. 5,996,539, assigned to FEV Motorentechnik GmbH & Co KG, is an EMVVA actuator including an adjusting device to vary the valve strokes. The adjusting device supports and controls the displacement of a base of the opener spring, thus controlling the pre-stress of the two actuation springs and the neutral position of the armature. At the least and most pre-stressed states of the actuation springs, the engine valve operates at partial and normal strokes, respectively. The design has the potential to resolve the valve stroke variability issue associated with most EMVVA designs. However, it fails to provide a solution to meet the need to keep the engine valve closed at power-off , and it also entails an additional hydraulically-operated-and-controlled locking mechanism, which incurs added complexity and reliability concern, to stabilize the adjusting device for partial stoke operations.

SUMMARY OF THE INVENTION

Briefly stated, in one aspect of the invention, one preferred embodiment of an electromechanical actuator comprises a housing, first and second electromagnets rigidly disposed in the housing and separated from each other by an armature chamber, an armature disposed in the armature chamber and movable between the first and second electromagnets, an armature rod rigidly connected with the armature and operably connected with a load, at least one first actuation spring biasing the armature in a first direction, at least one second actuation spring biasing the armature in a second direction, and one fluid-operated spring controller capable of controlling the position of the first-direction end of the at least one second actuation spring.

In operation, the actuation springs drive the armature and the load through pendulum motions between the first and second electromagnets, which in turn latch, over desired periods of time, and release the armature. The spring controller allows the actuation springs at their least compressed state and the engine valve closed when power is off or when the control fluid pressure is below a certain level or threshold. The spring controller may also be adjusted, with a low or moderate control fluid pressure, to allow the engine valve to operate with a partial lift.

In another embodiment, the spring controller allows the engine valve to operate with a small lift when the control fluid pressure is below a certain level or threshold. In still another embodiment, the spring controller includes a damping mechanism, without too much more complexity, to stabilize its operation.

The present invention provides significant advantages over the prevailing EMVVA actuators and their control. For example, it can effectively close the engine valve at power-off to meet certain vehicle regulations. The closed engine valve is also a good start-up point for the next power-on procedure or initialization. The invention also provides means to efficiently and effectively operate engine valves with a small lift. The present invention thus provides, with one mechanism, at least three significant functions: a closed engine valve at power-off, easy start-up, and partial or variable stroke. The present invention also provides partial stroke operation stability without too much more complexity.

The present invention, together with further objects and advantages, will be best understood by reference to the following detailed description taken in conjunction with the accompanying drawings.

DETAILED DESCRIPTION OF THE INVENTION

Figure 1:
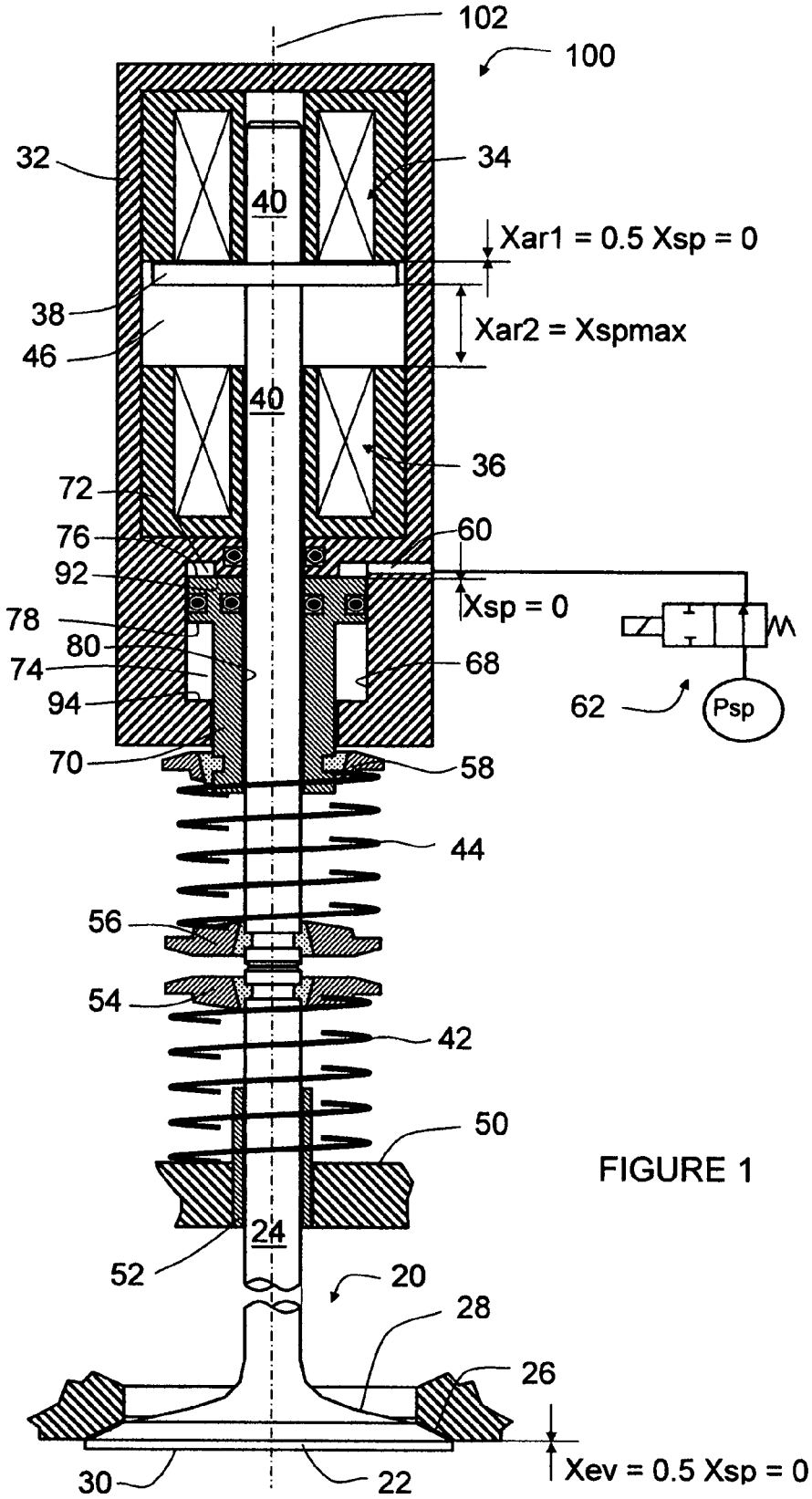
FIG. 1 is a schematic illustration of one preferred embodiment of the electromechanical actuator, at its zero-lift state.

Referring now to FIG. 1, a preferred embodiment of the invention provides an engine valve control actuator 100. The actuator 100 includes a housing 32. Rigidly disposed within the housing 32, along the longitudinal axis 102 and from a first to a second direction (from the top to the bottom in the drawing), are a first electromagnet 34, an armature chamber 46, a second electromagnet 36, and a spring-controller cylinder 68. The first and second electromagnets 34 and 36 further include their electrical windings and lamination stacks. An armature 38 is disposed inside the armature chamber 46 and between the first and second electromagnets 34 and 36 and is rigidly connected to an armature rod 40. The armature rod 40 is slideably disposed through the first and second electromagnets 34 and 36, the housing 32, and a spring controller 70. The spring controller 70 is slideably disposed within the spring-controller cylinder 68 and through the second-direction end of the housing 32. The armature rod 40 is operably connected, at its second-direction end, with the stem 24 of an engine valve 20, which is guided by an engine valve guide 52 rigidly disposed in the cylinder head 50. The engine valve 20 includes an engine valve head 22 with first and second surfaces 28 and 30 exposed to gaseous pressure forces. The engine valve head 22 moves relative to a valve seat 26, defining an engine valve opening Xev and controlling air exchange for an engine cylinder in an internal combustion engine (not shown in FIG. 1). The peak value of a cyclic valve opening is called the stroke or lift.

The actuator 100 further includes first and second actuation springs 42 and 44, concentrically wrapped around the engine valve stem 24 and the armature rod 40, respectively. The first actuation spring 42 is supported by a first spring retainer 54 and the cylinder head 50 at its first- and second-direction ends, respectively. The second actuation spring 44 is supported by a third spring retainer 58 and a second spring retainer 56 at its first- and second-direction ends, respectively. The first and second spring retainers 54 and 56 are fixed on the engine valve stem 24 and the armature rod 40, respectively, whereas the third spring retainer 58 is fixed on and thus moves with the second-direction end of the spring controller 70.

The first and second actuation springs are preferably substantially identical or symmetric in major geometrical, physical parameters, such as stiffness and preload to have an efficient pendulum system. They may be purposely designed to be somewhat asymmetric to achieve asymmetric needs for engine valve opening and closing, which, for example, experience dissimilar frictional forces and need different seating or slow-down strategies. For simplicity, the spring symmetry is assumed in many parts of the specification of this application, which does not however exclude the applicability of the embodiments and teachings of this invention to situations where asymmetric springs are more desirable.

The spring retainers 54 and 56 are illustrated to be of the shape generally used in current production engines. They do not have to be that way. In fact, when possible and practical, they may be combined into a single mechanical piece.

The spring controller 70 partitions the spring-controller cylinder 68 into spring-controller first and second chambers 72 and 74. The first chamber 72 is fed with a working fluid through a spring-controller port 60 and from a fluid supply at a pressure Psp. The fluid supply Psp is switched on and off by a spring-controller on-off valve 62. The second chamber is generally not pressurized and is exposed to either atmosphere or a fluid return line to the tank of the working fluid (not shown). Therefore there is negligible force on a spring-controller second surface 78. The fluid pressure force on a spring-controller first surface 76 balances the spring force on the third spring retainer 58 from the second actuation spring 44, resulting in the longitudinal position of the spring controller 70 and thus that of the third spring retainer 58, which in turn controls the neutral position of the armature and the engine valve. A neutral position is defined as a steady-state position only under spring forces, without electromagnetic forces and contact forces at electromagnets and the engine valve seat and generally ignoring gravitational and frictional forces. At a neutral state or position, the two spring forces are equal in magnitude and opposite in direction, and the net spring force is thus equal to zero. The position or travel of the armature and engine valve assembly is also limited in the first direction when the engine valve head 22 comes in contact with the engine valve seat 26 and in the second direction when the armature 38 comes in contact with the second electromagnet 36. The position or travel of the spring controller 70 is limited by spring-controller cylinder first and second surfaces 92 and 94 in the first and second directions, respectively.

The spring controller 70 can be alternatively designed without the flange feature that gives off, or is characterized in the form of, the spring-controller second surface 78 shown in FIGS. 1-7. The elimination of the flange feature may facilitate the assembly process in certain situations. Without the flange feature, the travel of the spring controller 70 may be limited by some other lock-up mechanisms. For example, a mechanical block, not shown in FIGS. 1-7, may be placed at a predetermined longitudinal position to limit the range of the travel of the third spring retainer 58 and thus that of the spring controller 70 in the second direction.

Power-Off State

At power-off, the spring-controller on-off valve 62 is at its default or open position, and the fluid supply pressure Psp is generally at the atmosphere pressure or zero gage pressure. The spring controller 70 is thus at its farthest position in the first direction, with its first surface 76 butting against the spring-controller cylinder first surface 92, and the actuation springs 42 and 44 are at their least compressed states. The actuator 100 is so geometrically and physically designed such that the engine valve 20 is fully closed with a finite seating or contact force, if desired, and the armature 38 is substantially approximate, depending on the lash, to the first electromagnet 34. The armature and engine valve assembly are not exactly in the neutral position if the seating force is not zero.

Because of thermal expansion, wear and elasticity in an engine valve mechanism, the longitudinal dimension stack-up is not exact, and lash adjustment has to be considered. When the armature 38 is latched to the first electromagnet 34, they may not necessarily be in real physical or metal-to-metal contact. For simplicity of discussion and illustration, the clearance between the armature 38 and the electromagnet 34 and its variation, when they are latched, are to be ignored or de-emphasized. But that does not exclude the general applicability of the embodiments and teachings of this invention to situations with substantial lash.

Symbolically in FIG. 1, the variable Xsp is defined the spring controller displacement, which is a distance between the spring-controller first surface 76 and the spring-controller cylinder first surface 92. The variable Xev is defined as the engine valve opening, a longitudinal distance between the engine valve head 22 and the engine valve seat 26. The variables Xar1 and Xar2 are defined as armature first and second air gaps, respectively, for the distance between the armature 38 and the first electromagnet 34 and that between the armature 38 and the second electromagnet 36. Ignoring the engine valve lash and at power-off, one generally has Xsp=0, Xev=0, Xar1=0, and Xar2=Xspmax−Xar1=Xspmax, where Xspmax is the maximum spring-controller displacement.

The actuator 100 falls into the power-off state soon after the engine power is turned off, either intentionally or by accident, keeping the engine valve closed as required in some vehicle regulations. From this power-off state, it is also easy to initialize the actuator 100 at the engine start-up, without spending too much energy (see the following discussion).

Start-Up

At the power-off state as shown in FIG. 1, the armature first air gap Xar1 is substantially equal to zero. The actuator 100 can be initialized by energizing only the first electromagnet 34 to a holding level of force, thus latching the armature 38 to the first electromagnet 34, mostly by force and not by physical contact. The holding level of force is much smaller than the force otherwise needed to attract the armature 34 if it is in the middle of the armature chamber 46.

Figure 2:
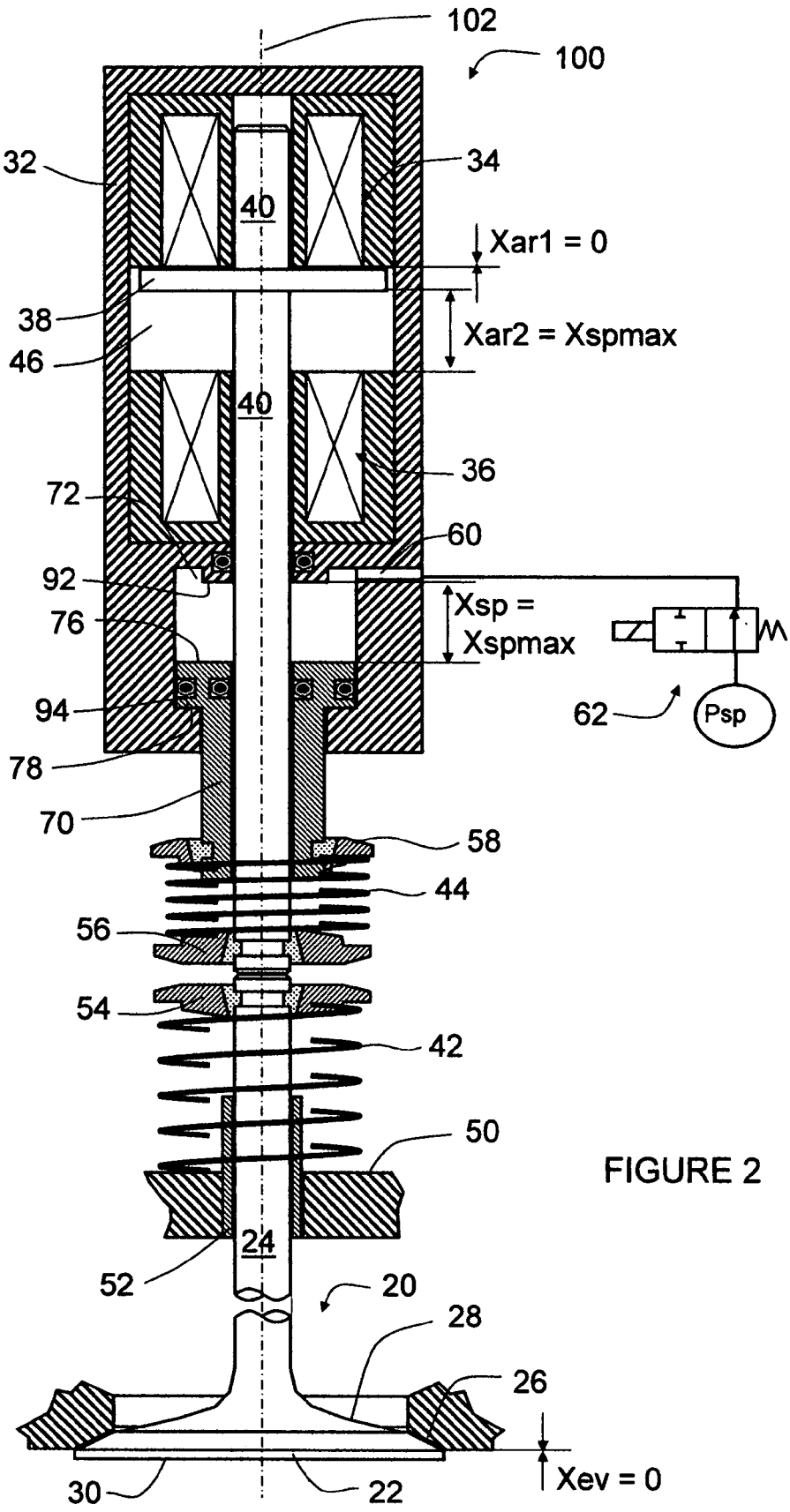
FIG. 2 is a schematic illustration of the embodiment of FIG. 1 at the end of the start-up process, when the second actuation spring is greatly compressed.

Also at the start-up, the fluid supply builds up its pressure Psp, and the pressure force starts pushing the spring controller 70 in the second direction until it is against and limited by the spring-controller cylinder second surface 94, with Xsp=Xspmax. However, this pressure build-up and the subsequent spring controller displacement are much slower than the action to energize the first electromagnet 34 and latch the armature 38, and the armature-and-engine valve assembly stay securely latched as shown in FIG. 2. FIG. 2 illustrates the state of the embodiment at the end of the start-up process, when the second actuation spring 44 is greatly compressed, the spring controller 70 is secured by the working fluid at the farthest position in the second direction, and the engine valve 20 is fully closed.

Full Lift Operation

Figure 3:
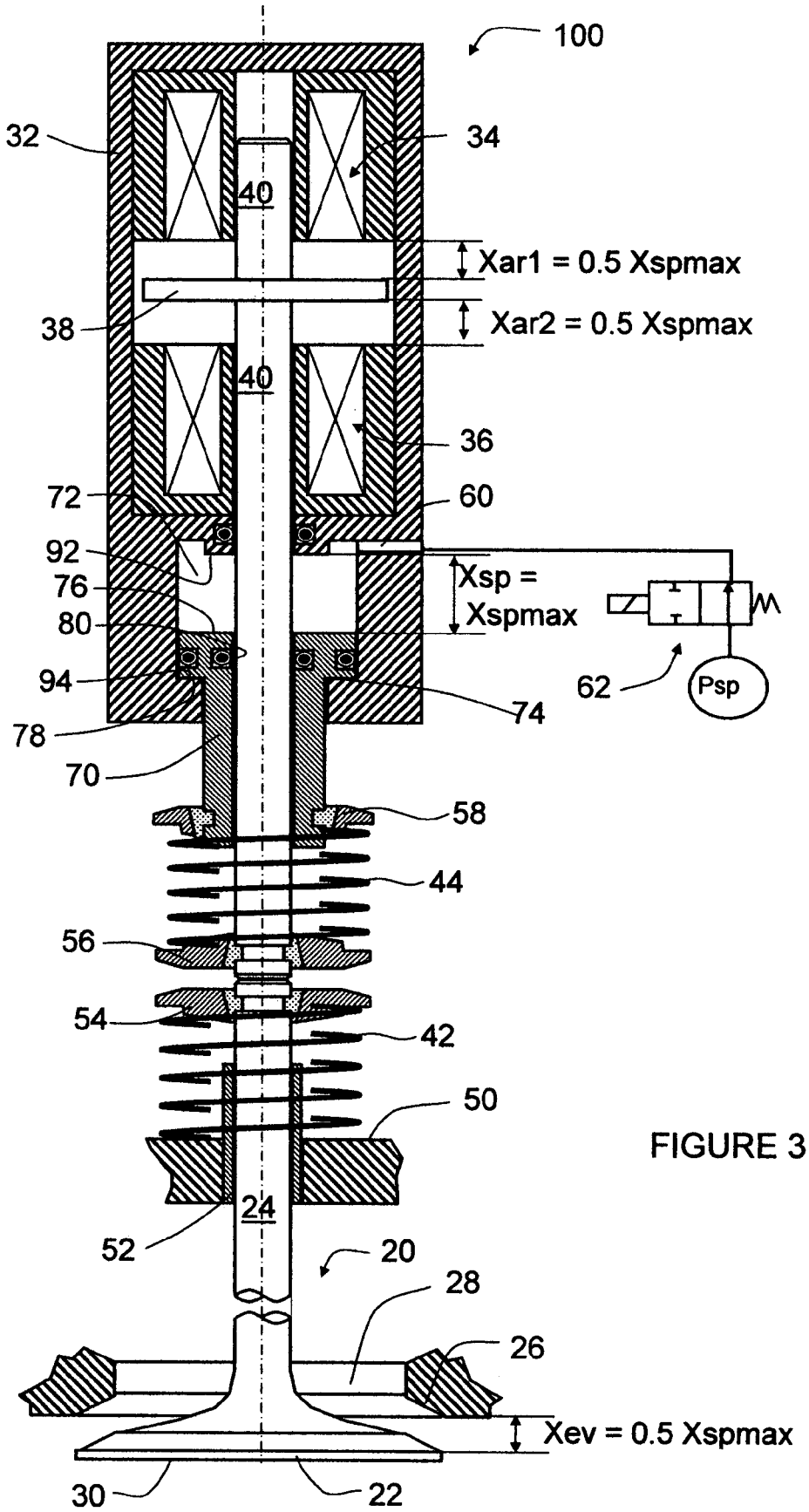
FIG. 3 is a schematic illustration of the embodiment of FIG. 1 when the actuation springs are substantially equally compressed, the net spring force is zero, the armature is at the middle point between the electromagnets, and the engine valve is half open.

For the normal, full or maximum lift operation, the spring controller 70 remains in the position as shown in FIG. 2, and the actuator 100 operates otherwise like a prevailing EMVVA actuator. The two actuation springs 42 and 44 alternatively store and release potential energy, and the armature-and-engine valve assembly travels like a pendulum, with the armature 38 being latched at the two electromagnets 34 and 36 for fully closed and open positions, respectively. Between the two end positions is a neutral position as shown in FIG. 3, where the actuation springs 42 and 44 are substantially equally compressed, the net spring force is zero, the armature 38 is at the middle point between the electromagnets 34 and 36 with Xar1=Xar2=0.5 Xspmax, and the engine valve 20 is half open with Xev=0.5 Xspmax.

Small Lift Operation

The actuator 100 is also able to operate at a small lift. The spring controller 70 illustrated in FIG. 4 experiences a small displacement Xspsmall when the fluid supply pressure Psp is adjusted or controlled to a low or moderate value. The resulting neutral positions (shown in FIG. 4) for the armature and the engine valve are not far away from the fully closed positions, with Xar1=0.5 Xspsmall and Xev=0.5 Xspsmall. The armature 38 and the engine valve 20 are held in these neutral positions by the force balance between the two actuation springs 42 and 44 while the position of the third spring retainer 58 results from the balance between the fluid force on the spring-controller first surface 76 and the spring force from the second actuation spring 44. Therefore, the small engine valve opening Xev=0.5 Xspsmall is achieved and maintained without the usage of electrical power or energy. It is however conceivable to use a smaller electromagnetic force from the first electromagnet 34 to perform a closed-loop position control if better opening accuracy is desired, with the correctional electromagnetic force increasing with the engine valve opening overshoot beyond the target value to pull the armature 38 and thus the engine valve 20 in the first direction to reduce the deviation. One can purposely bias the open-loop engine valve opening data points more into the overshoot (vs. undershoot) range to deal with the inability of the first electromagnet 34 to push the armature 38 in the second direction because of the nature of the electromagnetic force and the ineffectiveness of the second electromagnet 36 to pull the armature in the second direction because of the large second air gap Xar2 during the small lift operation.

Figure 4:
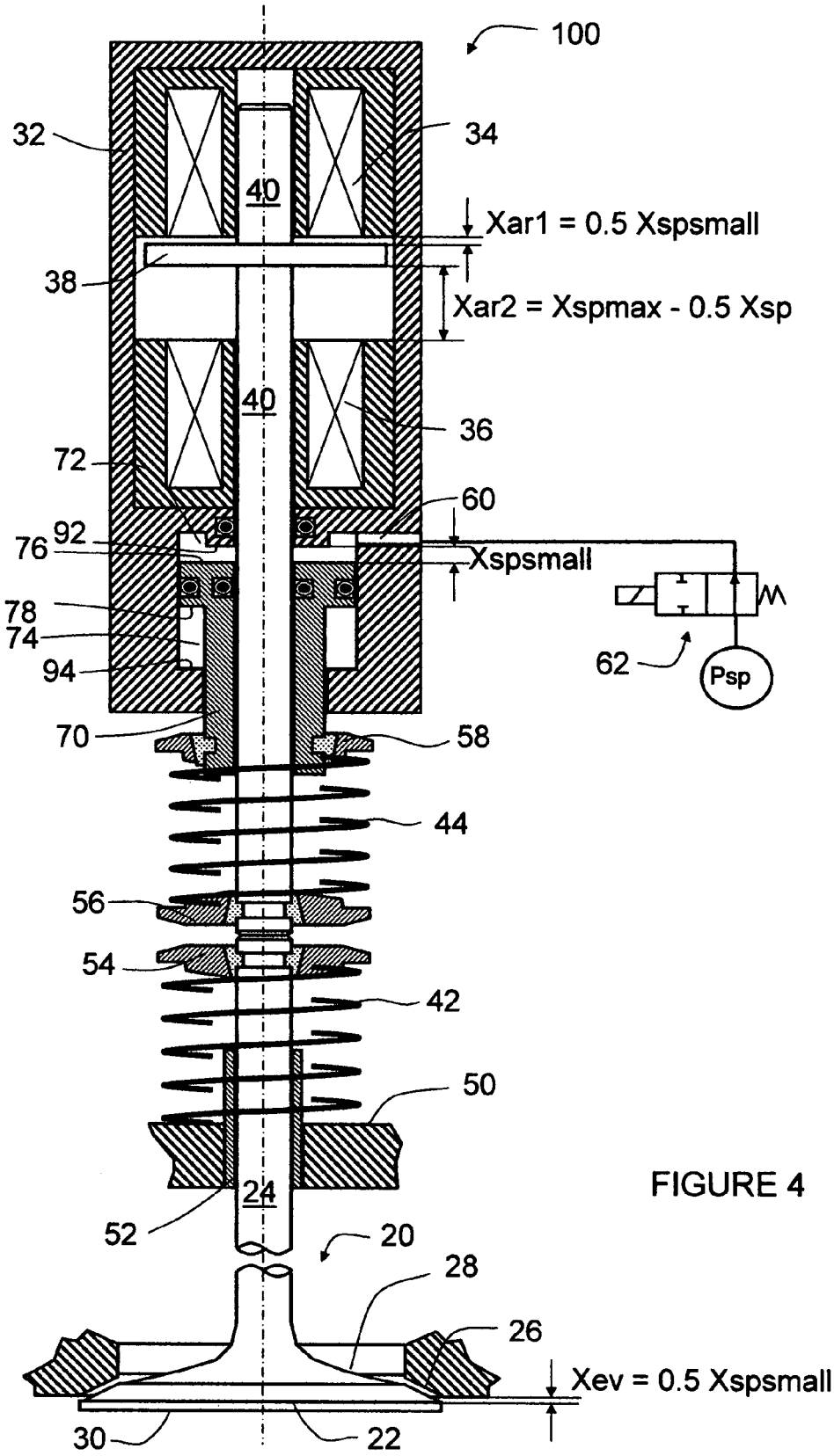
FIG. 4 is a schematic illustration of the embodiment of FIG. 1 with the spring controller experiencing a small displacement when the fluid supply pressure is adjusted to a low or moderate value.

It is also possible to use a lock-up mechanism, such as a fluid actuated lock pin (not shown in FIG. 1) to accurately pin-down the spring controller 70 to the small displacement Xspsmall. To close the engine valve 20, the first electromagnet 34 is energized to pull the armature 38 in the first direction and hold it once the engine valve is closed, all against the net spring force. To open the engine valve 20 afterwards, the first electromagnet 34 is de-energized for the armature 38 and the engine valve 20 to return, under the net spring force, to the neutral positions as shown in FIG. 4.

This small lift operation operates differently from that with the full lift, and the engine valve opens and closes under the net spring force and the electromagnetic force, respectively, instead of under generally symmetric, pendulum dynamics. The armature 38 is latched at the closed position and balanced at the open position by the first electromagnet 34 and the actuation springs 42 and 44, respectively, instead of by the first and second electromagnets 34 and 36, respectively. In fact, the second electromagnet 36 may not be involved at all. This asymmetric operation is, in theory, not energy efficient, but it is, in absolute terms, still efficient because of its much reduced lift. In addition, the balance at the engine valve open position, a neutral position, is achieved by the actuation springs 42 and 44, without consuming electrical energy. With a prevailing EMVVA actuator, a substantial amount of electrical energy has to be consumed to counter a large spring return force at this position, which is not a neutral position in a prevailing design.

During the operation, the second actuation spring 44 does change its level of compression and offers a varying force to the spring controller 70, which makes it necessary to incorporate design considerations to damp out oscillatory displacement for the spring controller 70.

It is generally preferred for all VVA actuators 100 in an engine to use a single fluid supply. When the system changes its supply pressure Psp from a high pressure to a lower pressure for a small lift operation or vice versa, timing of the system pressure change may not be ideal for individual actuators 100. The system control may purposely closes off an individual spring-controller on-off valve 62 by energizing its solenoid to momentarily isolate its associated spring controller 70. Otherwise, the spring-controller on-off valve 62 may be eliminated from the system to simplify.

Figure 5A:
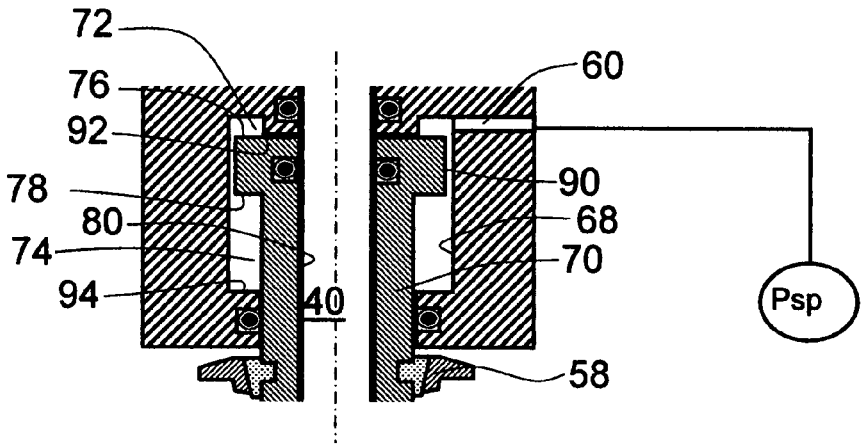
FIG. 5A is a schematic illustration of another preferred embodiment including an intentional, substantial gap between the spring-controller cylinder and the spring-controller piston outer dimension to pressurize both spring-controller first and second chambers.
Figure 5B:
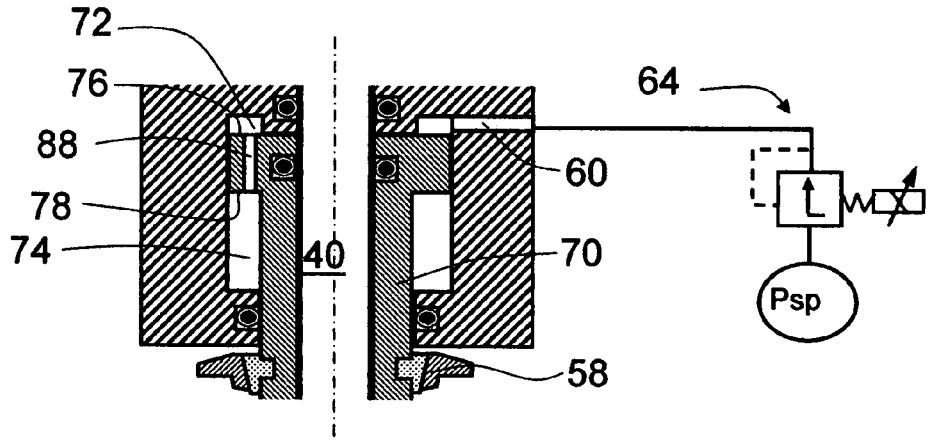
FIG. 5B is a schematic illustration of yet another preferred embodiment including at least one spring-controller orifice that is to equalize steady-state pressures in the spring-controller first and second chambers and provide damping effect to reduce oscillation the spring controller may experience.
Figure 5C:
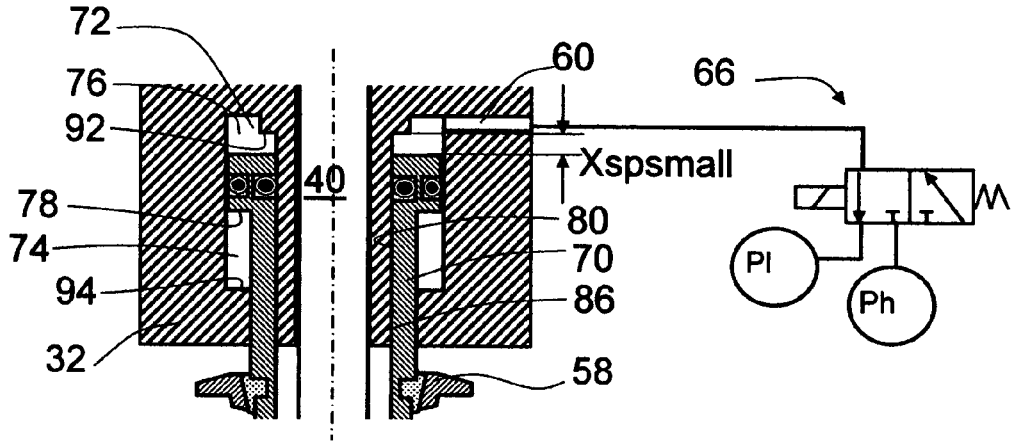
FIG. 5C is a schematic illustration of another preferred embodiment including a housing extension.

The spring controller 70 and its associated fluid actuation design illustrated in FIGS. 1 to 4 are only one of many possible combinations of piston-cylinder designs and fluid supply systems. FIGS. 5A, 5B, and 5C illustrate a few other embodiments, with graphic details only around the spring controller 70 and its fluid supply subsystem to emphasize their variations. The embodiment in FIG. 5A features an intentional, substantial gap or clearance between the spring-controller cylinder 68 and the spring-controller piston, or flange, outer dimension 90 to pressurize both spring-controller first and second chambers 72 and 74. The gap may function as a damping orifice, or flow restriction, between the two pressurized chambers 72 and 74 to counter the oscillatory force from the second actuation spring. This substantial gap eliminates one pair of tightly sliding surfaces and reduces manufacturing cost. This embodiment offers, as a design option, a reduced effective pressure area, which is equal to the differential area between the first and second surfaces 76 and 78. The embodiment in FIG. 5A also features no spring-controller on-off valve 62 (used in the embodiment illustrated in FIG. 1), which reduces some control flexibility while simplifying the overall structure of the actuator or system.

The embodiment in FIG. 5B features at least one spring-controller orifice 88, a flow restriction, that is to equalize steady-state pressures in the spring-controller first and second chambers 72 and 74 and provide damping effect to reduce oscillation the spring controller 70 may experience. This embodiment also offers, as a design option, a reduced effective pressure area, which is equal to the differential area between the first and second surfaces 76 and 78. This embodiment features a spring-controller pressure control valve 64, which is able to provide individualized pressure control for the actuator. If needed, the feedback control can be incorporated based on the position information of the spring controller 70. Physically, the spring-controller pressure control valve 64 can be any of many possible proportional pressure control valve, such as a variable force solenoid (VFS) valve which delivers an output pressure either proportional or inversely proportional to the input current. Functionally, a VFS valve can also be replaced by a pulse width modulation (PWM) valve combined with a proper position or pressure feedback control (not shown here).

The embodiment in FIG. 5C features another variation in the spring control mechanism. In this embodiment, the spring controller bore 80 slides over a housing extension 86, instead of the armature rod 40. The housing extension 86 does not have to be an inseparable part of the housing 32 and can be a separate part but rigidly assembled or connected to the housing 32. This design can greatly reduce the potential for the working fluid to leak into the armature chamber 46 (see FIG. 1) through the clearance around the armature rod 40. It also provides more solid bearing or support to the traveling armature rod 40. The embodiment also features a spring-controller 3-way valve 66 that selectively feed the spring-controller first chamber 72 with the working fluid either from a high-pressure fluid supply Ph or a low-pressure fluid supply Pl. Ideally, the high-pressure Ph is set to push the spring controller 70 all the way against the spring-controller cylinder second surface 94 while the low-pressure Pl is set to drive the spring controller 70 to the small displacement Xspsmall designed for idle and low load engine operations. Although the fluid power symbol for the 3-way valve 66 indicates the Ph connection to be its default position, it is also feasible to have the Pl connection to be the default position. Alternatively, one may choose, for the valve 66, actuation means other than a combination of one return spring and one solenoid.

The design variations of the spring controller mechanisms and the fluid supply schemes illustrated in FIGS. 5A, 5B, and 5C can be recombined among themselves and with other possible variations.

Figure 6:
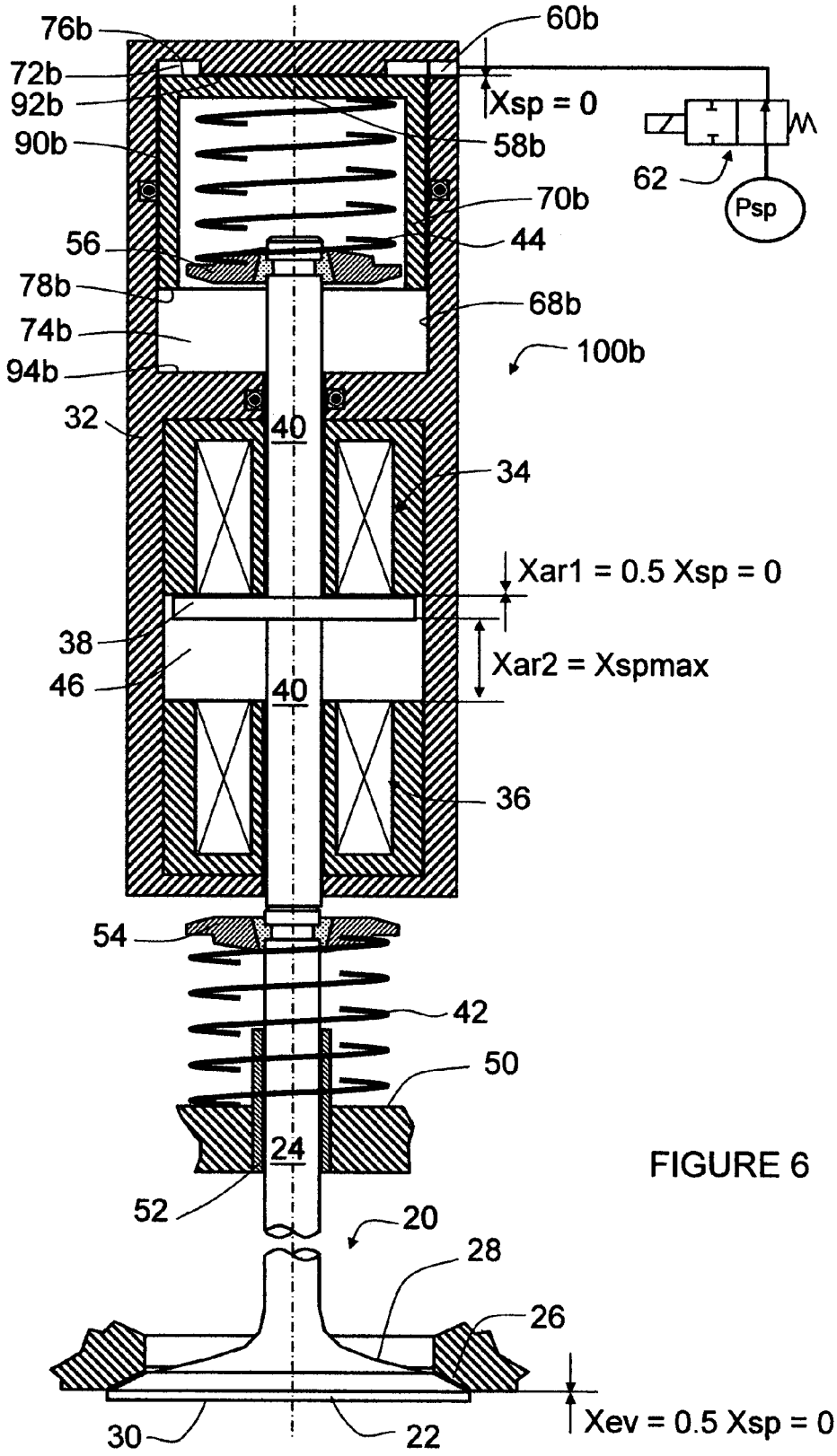
FIG. 6 is a schematic illustration of another preferred embodiment with the second actuation spring and the spring controller relocated to the first-direction end of the actuator.

FIG. 6 demonstrates a variation of the embodiment illustrated in FIG. 1. In this case the second actuation spring 44 and the associated spring controller 70*b* are relocated to the first-direction end of the actuator 100*b*. The spring-controller first chamber 72*b* is pressurized, and it can be supplied, through the spring controller port 60*b*, by several possible fluid sources like those for the embodiments in FIGS. 1-5C. The spring-controller second chamber 74*b* is generally not pressurized and is fluid communication (details not shown in FIG. 6) either with the atmosphere or a return line to the tank of the working fluid. Basic schemes utilized for the spring controller in the embodiments in FIGS. 5A, 5B, and 5C can also be incorporated in this embodiment.

When the spring-controller first surface 76*b* is in contact with the spring-controller cylinder first surface 92*b* (as shown in FIG. 6), the steady-state net spring force secures the armature 38 substantially approximate to the first electromagnet 34 and the engine valve 20 at its closed position, with the required contact force. This is an ideal situation for power-off or default position and actuator initialization. When the spring-controller second surface 78*b* is in contact with the spring-controller cylinder second surface 94*b* (not shown in FIG. 6), the steady-state net spring force moves the neutral position of the engine valve 20 to be in the substantially middle point, if so desired, between the closed and full open positions.

Figure 7:
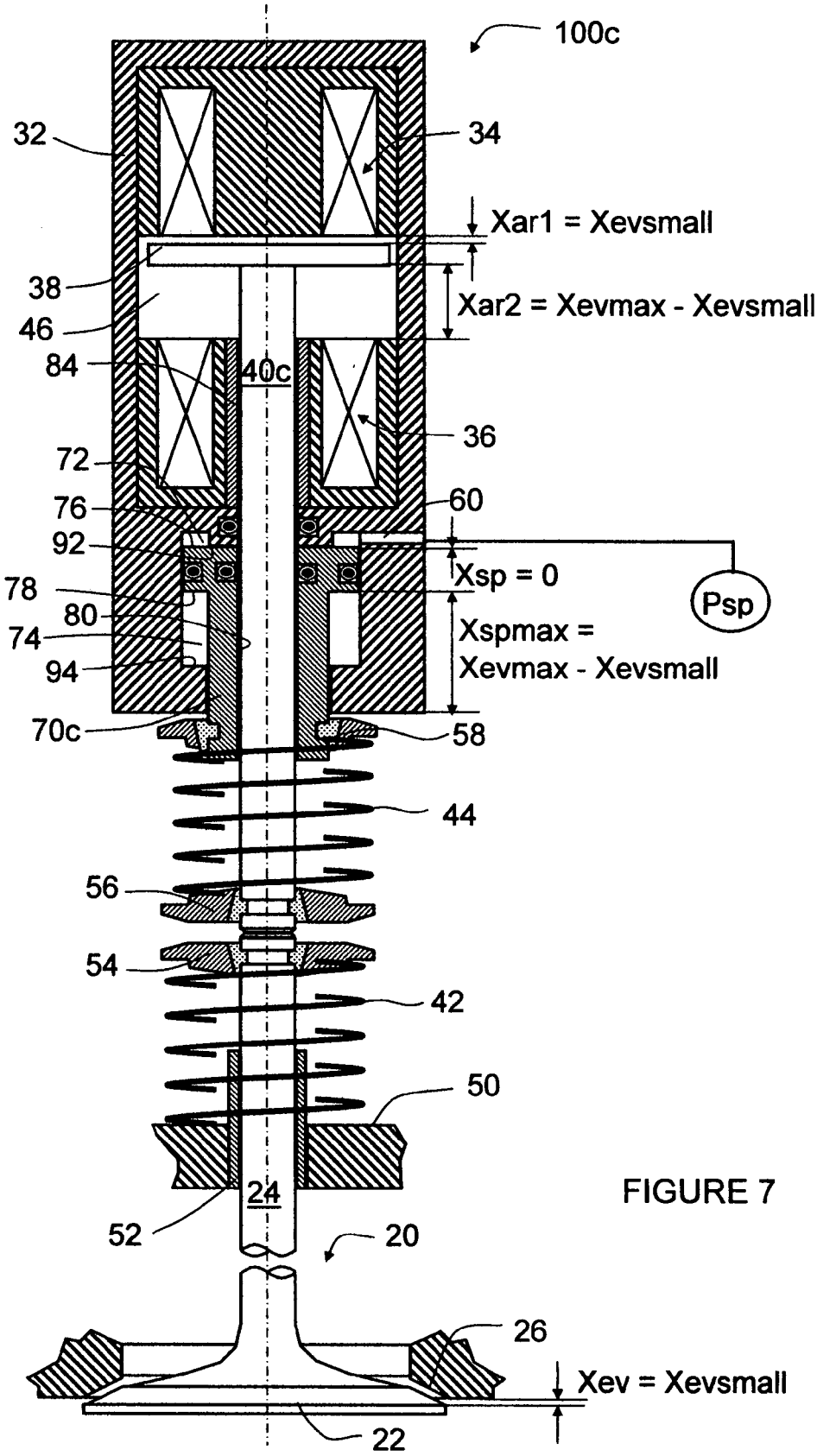
FIG. 7 is a schematic illustration of another preferred embodiment, in which the steady-state or power-off armature first air gap and the engine valve opening are equal to a small value, instead of zero, when the spring-controller first surface is up against the spring-controller cylinder first surface.

Refer now to FIG. 7, which is a drawing of yet another preferred embodiment of the invention. When the spring-controller first surface 76 is up against the spring-controller cylinder first surface 92, the steady-state or power-off armature first air gap Xar1 and the engine valve opening Xev are not equal to zero, and, instead, Xar1=Xev=Xevsmall, where Xevsmall is small valve opening. This embodiment is useful in applications where engine valves are not required to be closed at power-off, and at the same time, the accuracy of the small valve opening Xevsmall is stringent, which can be greatly helped by the position accuracy of the spring controller 70*c* guaranteed by a solid stop against the cylinder first surface 92. The actuator 100*c* also features other design variations. The armature rod 40*c* does not extend beyond the armature 38 in the first direction, which may reduce the design complexity and weight. The rod 40*c* also slides inside an added sleeve 84 to provide proper mechanical support and specific material match.

In all the above descriptions, the first and second actuation springs 42 and 44 are each identified or illustrated, for convenience, as a single spring. When needed for strength, durability or packaging, however each or any one of the first and second actuation springs 42 and 44 may include a combination of two or more springs. In the case of mechanical compression springs, they can be nested concentrically, for example. The spring subsystem may also include a single mechanical spring (not shown) that can take both tension and compression. The spring subsystem may also include a combination of pneumatic and mechanical springs, or even two pneumatic springs.

Also in some illustrations and descriptions, the fluid medium may be assumed or implied to be hydraulic or in liquid form. In most cases, the same concepts can be applied, with proper scaling, to pneumatic actuators and systems. As such, the term "fluid" as used herein is meant to include both liquids and gases. Also, in many illustrations and descriptions so far, the application of the actuator 100 or 100*b* or 100*c* is defaulted to be in engine valve control, and it is not limited so. The actuator 100 or 100*b* or 100*c* can be applied to other situations where a fast and/or energy efficient control of the motion is needed.

Although the present invention has been described with reference to the preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of this invention.

I claim:

1. An electromechanical actuator, comprising first and second electromagnets separated from each other by an armature chamber;

an armature disposed in the armature chamber and movable between the first and second electromagnets;

an armature rod operably connected with the armature;

an engine valve operably connected with the armature rod;

at least one first actuation spring biasing the armature in a first direction;

at least one second actuation spring biasing the armature in a second direction; and one spring controller, controlling the position of one end of the at least one second actuation spring and thus the neutral position of the armature and engine valve, having an adjustable position between a zero displacement and a predetermined maximum spring-controller displacement, and the neutral position of the engine valve being a closed position when the spring controller position is at its zero displacement whereby the engine valve is closed at power-off.

2. The electromechanical actuator of claim 1, further including means for the spring controller to stay in between zero displacement and the predetermined maximum spring-controller displacement, whereby the engine valve to operate at partial as well as full strokes.

3. The electromechanical actuator of claim 1, wherein the spring controller is situated between the second electromagnet and the at least one second actuation spring, and the first and second actuation springs are distal in the second direction to the second electromagnet.

4. The electromechanical actuator of claim 1, wherein the spring controller is driven with a fluid medium.

5. The electromechanical actuator of claim 4, wherein the spring controller is slideably disposed within a spring-controller cylinder and around the armature rod.

6. The electromechanical actuator of claim 1, further including at least one damping mechanism, whereby reducing oscillation in the position of the spring controller.

7. The electromechanical actuator of claim 4, further including first and second chambers, and spring controller first and second surfaces of differential surface areas.

8. The electromechanical actuator of claim 7, further including at least one flow restriction between the first and second chambers, whereby reducing oscillation in the position of the spring controller.

9. The electromechanical actuator of claim 4, further includes a switchable fluid source.

10. The electromechanical actuator of claim 4, further includes a switch valve that supplies a fluid medium under at least two alternative levels of pressure.

11. A method of controlling an actuator comprising:

(a) providing an actuator including the following components:

first and second electromagnets separated from each other by an armature chamber;

an armature disposed in the armature chamber and movable between the first and second electromagnets;

an armature rod operably connected with the armature;

an engine valve operably connected with the armature rod;

at least one first actuation spring biasing the armature in a first direction;

at least one second actuation spring biasing the armature in a second direction; and one spring controller controlling the position of one end of the at least one second actuation spring and thus the neutral position of the armature and engine valve, having an adjustable position between a zero displacement and a predetermined maximum spring-controller displacement, and the neutral position of the engine valve being a closed position when the spring controller position is at its zero displacement; and (b) closing the engine valve at power-off by subjecting the spring controller primarily to the spring force and allowing sufficient axial extension of the actuation springs.

12. The method of claim 11, wherein further including means for the spring controller to stay in between zero displacement and a predetermined maximum spring-controller displacement, whereby the engine valve operates at partial stroke as well as full stroke.

13. The method of claim 11, wherein the spring controller is driven with a fluid medium.

14. The method of claim 13, wherein the fluid medium is de-pressurized automatically when the engine is off.

15. The method of claim 13, wherein the engine valve operates at a small stroke by adjusting the fluid supply pressure to a low or moderate value, and operates at a full stroke by adjusting the fluid supply pressure to a high value.

16. The method of claim 11, wherein the axial position of the spring controller is stabilized by a damping mechanism.

17. The method of claim 12, wherein the damping mechanism is in the form of a flow restriction.

18. The method of claim 13, further including a switch valve with a predetermined default or power-off position, whereby de-pressurizing the fluid medium at power-off.

19. The method of claim 11, wherein the spring controller is slideably disposed around the armature rod and within a spring-controller cylinder having an inner dimension, and has a flange feature possessing an outer dimension and dividing the spring-controller cylinder into first and second chambers, with a predetermined substantial clearance between the cylinder inner dimension and the flange outer dimension, whereby providing flow restriction between the first and second chambers to reduce position oscillation for the spring controller, eliminating one pair of tightly sliding surfaces, and reducing the associated manufacturing cost.

* * * * *